US007995029B2

(12) United States Patent
Johnson

(10) Patent No.: US 7,995,029 B2
(45) Date of Patent: Aug. 9, 2011

(54) DISPLAY APPARATUS WITH A DISPLAY DEVICE AND METHOD OF DRIVING THE DISPLAY DEVICE

(75) Inventor: Mark Thomas Johnson, Eindhoven (NL)

(73) Assignee: Adrea, LLC, Sunnyvale, CA (US)

( * ) Notice: Subject to any disclaimer, the term of this patent is extended or adjusted under 35 U.S.C. 154(b) by 828 days.

(21) Appl. No.: 10/531,035

(22) PCT Filed: Sep. 12, 2003

(86) PCT No.: PCT/IB03/04039

§ 371 (c)(1),
(2), (4) Date: Apr. 12, 2005

(87) PCT Pub. No.: WO2004/036537

PCT Pub. Date: Apr. 29, 2004

(65) Prior Publication Data

US 2006/0050361 A1 Mar. 9, 2006

(30) Foreign Application Priority Data

Oct. 16, 2002 (EP) ..... 02079282

(51) Int. Cl.
*G09G 3/34* (2006.01)

(52) U.S. Cl. ..... 345/107; 359/228

(58) Field of Classification Search ..... 345/107; 359/228; 296/70

See application file for complete search history.

(56) References Cited

U.S. PATENT DOCUMENTS

| | | | | |
|---|---|---|---|---|
| 4,203,106 | A * | 5/1980 | Dalisa et al. | 345/107 |
| 4,728,947 | A * | 3/1988 | Ayliffe et al. | 345/97 |
| 5,252,958 | A * | 10/1993 | Daniels | 345/107 |
| 5,684,501 | A * | 11/1997 | Knapp et al. | 345/94 |
| 6,323,989 | B1 * | 11/2001 | Jacobson et al. | 359/296 |
| 6,392,786 | B1 * | 5/2002 | Albert | 359/296 |
| 6,504,524 | B1 * | 1/2003 | Gates et al. | 345/107 |
| 6,507,330 | B1 * | 1/2003 | Handschy et al. | 345/94 |
| 6,531,997 | B1 * | 3/2003 | Gates et al. | 345/107 |
| 6,650,462 | B2 * | 11/2003 | Katase | 359/296 |
| 6,822,783 | B2 * | 11/2004 | Matsuda et al. | 359/296 |
| 6,950,220 | B2 * | 9/2005 | Abramson et al. | 359/265 |
| 6,961,047 | B2 * | 11/2005 | Katase | 345/107 |
| 6,982,732 | B2 * | 1/2006 | Suzuki | 345/693 |
| 7,202,847 | B2 * | 4/2007 | Gates | 345/98 |
| 2002/0113770 | A1 * | 8/2002 | Jacobson et al. | 345/107 |
| 2003/0011869 | A1 * | 1/2003 | Matsuda et al. | 359/296 |
| 2004/0036951 | A1 * | 2/2004 | Johnson et al. | 359/296 |

FOREIGN PATENT DOCUMENTS

| | | |
|---|---|---|
| JP | 03-091722 | 4/1991 |
| JP | 2003-280050 | 10/2003 |
| WO | WO0201540 A1 | 1/2002 |
| WO | WO03044765 A2 | 5/2003 |

* cited by examiner

*Primary Examiner* — Kevin M Nguyen
*Assistant Examiner* — Vinh Lam
(74) *Attorney, Agent, or Firm* — Finnegan, Henderson, Farabow, Garrett & Dunner, LLP

(57) ABSTRACT

A display apparatus including a matrix display device with pixels wherein particles move in a fluid between electrodes. An optical state of the pixels is defined by a value of a drive voltage and a duration of a drive period during which the drive voltage is present across the pixel. A DC-balancing circuit controls the amplitudes of the drive voltages and/or durations of drive periods to obtain a substantially zero time-average value across each pixel or across each sub-group of pixels. This control of the amplitude of the drive voltages and/or the duration of the drive periods allows minimizing the image retention, without requiring reset pulses causing all pixels to become temporarily white or black.

12 Claims, 2 Drawing Sheets

DISPLAY APPARATUS WITH A DISPLAY DEVICE AND METHOD OF DRIVING THE DISPLAY DEVICE

Figure 1:
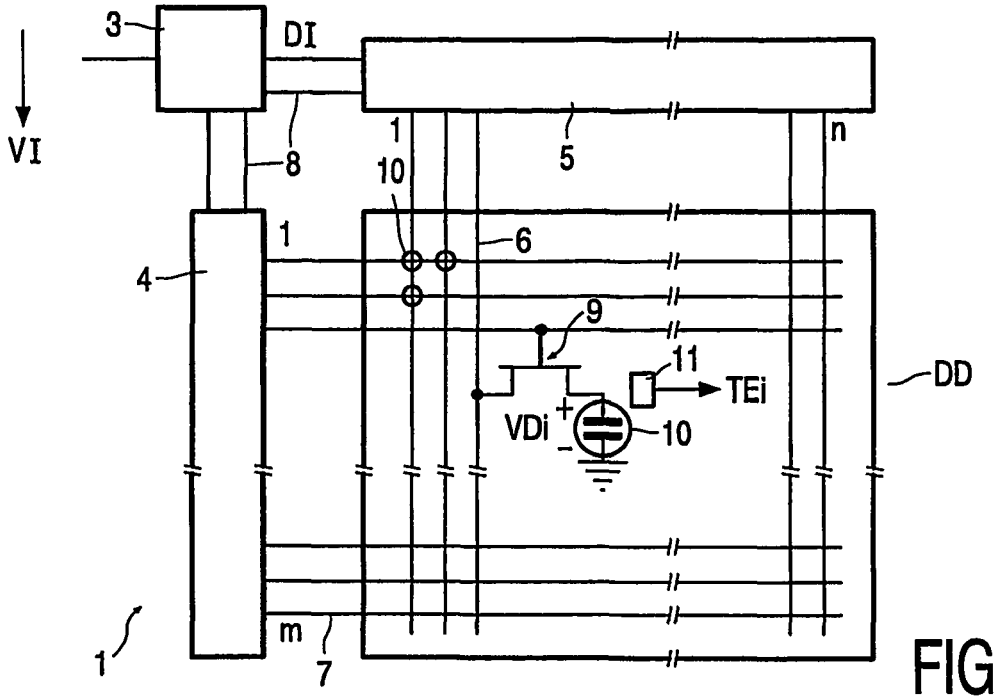

The invention relates to a display apparatus with a display device, and to a method of driving the display device.

The invention is particularly relevant for display devices wherein particles move in a fluid between electrodes, such as electrophoretic displays.

Usually, an electrophoretic display device is a matrix display with a matrix of pixels which are associated with intersections of crossing data electrodes and select electrodes. A grey level or a level of colorization of a pixel depends on the time a drive voltage with a particular level is present across the pixel. Dependent on the polarity of the drive voltage, the optical state of the pixel changes from its present optical state continuously towards one of the two limit situations (all charged particles are near the bottom or near the top of the pixel). Grey scales are obtained by controlling the time the voltage is present across the pixel.

Usually, all the pixels of the matrix display are selected line by line by supplying appropriate voltages to the select electrodes. The data is supplied in parallel via the data electrodes to the pixels associated with the selected line. The time required to select all the pixels of the matrix display once is called the sub-frame period. A particular pixel either receives a positive, a negative drive voltage, or a zero drive voltage during the whole sub-frame period, dependent on the change of the optical state required. A zero drive voltage is supplied to the pixel if the optical state should not change.

Usually, to be able to generate grey scales (or intermediate colored states), a frame period comprises a plurality of sub-frames. The grey scales of an image can be reproduced by selecting per pixel during how many sub-frames the pixel should receive which drive voltage (positive, negative, or zero). Usually, the sub-frames all have the same duration. Optionally, the duration of the sub-frames may be selected different.

In a display using an electrophoretic foil, many insulating layers are present between the ITO-electrodes. Time and data dependent voltage drops will cause serious image retention. Known methods of minimizing the image retention use reset pulses which are supplied to all pixels. The reset pulses cause the image displayed to become completely white or black after each sub-frame period. Consequently, these reset pulses seriously diminish the display performance because the display flashes between black or white (or between two color states) between separate images.

It is an object of the invention to reduce the image retention with less impact on the visual performance of the display.

A first aspect of the invention provides a display apparatus with a display device, A and a second aspect of the invention provides a method of driving the display device. Advantageous embodiments are defined in the dependent claims.

The display apparatus in accordance with the invention comprises a display device with pixels wherein particles move in a fluid between electrodes. An optical state of the pixels usually is defined by a value of a drive voltage and a duration of a drive period during which the drive voltage is present across the pixel. An example of such a display device is an electrophoretic display.

A gray scale of a particular pixel depends on the level of the drive voltage and/or a duration of the drive period during which the drive voltage is present across the pixel. The driver supplies a sequence of drive voltages across the pixel during corresponding successive drive periods. The drive voltages and the duration of the drive periods have to be selected to obtain an optical state of the pixel fitting the image signal to be displayed.

A DC-balancing circuit controls the amplitudes of the drive voltages and/or durations of the drive periods for every pixel separately (or for relatively small sub-groups of adjacent pixels) to obtain a substantially zero time-average value of the drive voltage across each of the pixels. This control of the amplitude of the drive voltages and/or the duration of the drive periods allows minimizing the image retention, without requiring reset pulses for all the pixels. The reset pulses supplied to all the pixels cause the image displayed to become completely white or black regularly. Consequently, in accordance with the present invention, the image retention is minimized with less disturbing visual effects.

In a display device in which gray scales are generated by using a fixed value of the drive voltage (positive and negative, and zero) and a variable duration of the drive periods, it is possible to vary the value of the drive voltage across the pixel, within limits, to compensate for the variable duration of the drive periods. The compensation takes into account that the drive voltage changes sign dependent on whether the pixel should become darker or lighter (or more or less colored) or the other way around.

In an embodiment of a display device, in which a drive voltage is supplied to the pixel with a level such that the grey level (or the amount of colorization) does not change anymore after an initial period of time, the DC-balancing can be performed by varying the duration of the drive periods.

It is also possible to control both the duration of the drive periods and the drive voltage.

In an embodiment, the DC-balancing is obtained by summing in a memory a number that indicates a multiplication of a duration of the drive period (for example, the number of sub-fields the drive voltage is supplied to the pixel, if all the sub-fields have the same duration) for this pixel and a value of the drive voltage supplied to this pixel during said drive period. The number indicates the integrated voltage over the pixel. The value of the drive voltage and/or the duration of the drive period is adapted such that the number is kept as near as possible to substantially zero.

Preferably, the number is calculated and stored for every pixel of the matrix display. This allows to DC-balance all the pixels separately. It is also possible to calculate the number for subgroups of adjacent pixels. This is based on the insight that the optical state of adjacent pixels usually will not differ much over a longer period of time. Preferably, the subgroups comprise only a few adjacent pixels, for example two horizontally or vertically adjacent pixels.

In the usual sub-field driven matrix display drive, if the drive voltage is fixed, and if the subfields all have the same duration, the number may be determined by counting the number of sub-fields of a field during which the drive voltage is present. Dependent on the polarity of the drive voltage, this number has to be added or subtracted from the number determined so far.

The DC-balancing circuit controls the number of sub-fields during which the drive voltage is present across the pixel, and/or the drive voltage such that the number is as near to zero as possible.

For example, if the number indicates that a positive drive voltage has prevailed across the pixel up till now, and during a next field the optical state of the pixel has to change such that a negative drive voltage is required, the number of subfields during which the negative voltage is supplied is larger than necessary to reach the optical state required. In this way, the number will change in the direction of zero. Preferably, the display is driven such that still the correct optical state is reached. For example, a display may be used in which below or above a certain value of the drive voltage the speed of change of the optical state is not further influenced. Or, a display may be used in which at a particular value of the drive voltage the optical state changes during an initial period of time only. After the initial period of time, the drive voltage, although still present across the pixel, will have substantially no effect on the optical state of the pixel. With respect to preferred embodiments of the invention as claimed in claim 10 or 11, such a display and its drive is elucidated in more detail.

It is not required that the number is zero every drive period of a particular pixel. The range in which the level of the drive voltage can be varied and/or wherein the display period can be varied is limited. A too high voltage will damage the display device; a too low voltage may have no effect on the optical state of the pixel. Further, usually, a predetermined minimum time is required to obtain a change in the "grey"-level of a pixel, and a too long time will be impossible because the drive voltage can not be supplied longer than during all the sub-fields of a field. However, it is possible to (temporarily) increase the duration of the field period. Of course, a too large field period will decrease the refresh time of the display device too much; this may cause motion artifacts and a too large dissipation.

Due to the limited freedom in selecting the level of the drive voltages and the duration of the drive periods, the number may vary around zero without actually becoming zero. In the situation that a display is used in which the optical state of the pixel does not anymore change after the initial period in time, and the sub-field period is the smallest period of time the duration of the drive period can be changed, in principle it always will be possible to reach the zero value of the number because dependent on the polarity of the drive voltage always an integer times the same basic time period (the sub-field period) will be added or subtracted. However, if the drive voltage of a particular pixel has almost always the same polarity during successive field periods, at may take a substantial amount of fields before the number is controlled to zero again.

Further, in contradiction to LCD displays, positive and negative drive voltages with a same absolute value cause different optical states. It is thus not possible to simply DC-balance the voltage across the pixel by periodically changing the polarity of the drive signal. Dependent on the image to be displayed, it might occur that in several successive drive periods, during successive frames, the same polarity of the drive voltage occurs. During such a sequence of drive periods, no DC-balancing is possible, and consequently it will be impossible to keep the number close to zero. But, as soon as a drive period occurs with a drive voltage having an opposite polarity, the drive voltage and/or the duration of the drive period will be selected larger than necessary to change the number as much as possible towards zero.

In an embodiment, the matrix device is driven in the usual sub-field mode wherein each field comprises a predetermined number of sub-fields. During a particular field, a grey scale of a particular one of the pixels is determined by the particular number of sub-fields the drive voltage is present across the particular pixel. Consequently, the drive period of this particular pixel is the duration of this particular number of sub-fields.

In an embodiment, if the absolute value of the number for a particular pixel surpasses a threshold number, a reset pulse is supplied to the pixel. This reset pulse operates in the same manner as in the prior art. It is an advantage over the prior art that this reset pulse is supplied only sporadically and only to those pixels where it is required, and thus the visual performance is degraded less frequently and only for the relevant pixels. After the reset pulse, the value of the number corresponding to the relevant pixels is corrected to take the influence of the reset pulse into account.

In an embodiment, the number also depends on the temperature of the pixel to account for the fact that the image retention proceeds more quickly at higher temperatures.

In an embodiment, the number depends non-linearly on the value of the drive voltage to cope with the non-linear relation between the image retention and the drive voltage.

It is also possible to correct the number for both the temperature and the value of the drive voltage.

In an embodiment, a desired colorization (or the grey level) of the pixel is reached after an initial period of time (also referred to as the initial duration of the drive period, or the initial duration). A longer duration of the drive period will not (substantially) affect the coloration of the pixel. If the number indicates that a particular polarity of the drive voltage prevailed up till now, and if a polarity of the present drive voltage is opposite to the prevailing polarity, the controller controls the duration of the present drive period to become longer than the initial period of time. Usually, the duration of the present drive period is controlled to become longer by supplying the drive voltage during more sub-fields of a field to the pixel.

Due to the opposite sign of the present drive voltage, the absolute value of the number will become smaller when the multiplication of the present drive voltage times the duration of the present drive period (usually indicated by the number of sub-fields during a field that the drive voltage is presented to the pixel) is summed to the value of the number accumulated so far.

In general, when the duration of the drive period can be selected at will, it is possible to select the present duration of the drive period sufficiently long to obtain an exactly zero value for the number.

In an embodiment, if the initial duration causes the number to change sign, the duration of the present drive period will not be selected longer than the initial duration of the drive period.

In an embodiment, if the number indicates that a particular polarity of the drive voltage prevailed, and if a polarity of the present drive voltage is identical to this prevailing polarity, the duration of the present drive period is selected to be substantially identical to the initial duration. In this manner, the absolute value of the number will increase minimally.

In an embodiment, the pixel comprises two switching electrodes and a further electrode and the driver supplies drive voltages to the electrodes to control intermediate optical states of the pixel. This has the advantage that the optical state of the pixel after the initial period of time will not change anymore, even if the drive voltage is still present. In such a display, the DC-balancing is preferably performed by only controlling the duration of the drive periods. In particular by enlarging the duration of the drive periods to become larger than the initial period of time to minimize the value of the number.

This way of driving is explained in more detail in the European patent application EP-P-01200952.8. This document discloses the recognition that the electric field within a pixel can be influenced by electric voltages on the further electrode in such a way that, for example, the electric field lines at a positive voltage between the switching electrodes is disturbed in such a way that the negatively charged particles move towards a portion of the surface between one of the switching electrodes and the further electrode. Dependent on the electric voltages across the switching electrodes and the further electrode (or several further electrodes), more or less particles move towards the surface between the one of the switching electrodes and the further electrode and different intermediate optical states (grey values) are obtained.

In an embodiment, the pixel comprises at least two electrodes, and the driver supplies the drive voltages between the at least two electrodes for setting a grey scale of the pixel by providing a drive voltage lower than a usually applied drive voltage. The usually applied drive voltage sets a grey level by modulating the duration of the drive period during which the usually applied drive voltage is present. Also, in this display, the DC-balancing is preferably performed by only controlling the duration of the drive periods.

This way of driving is explained in more detail in PCT International Publication Number WO 03/093900. This non-prepublished European patent application discloses the recognition that in electrophoretic displays, if a constant low drive voltage is applied across the pixel, the combination of the fluid and the charged particles in the pixel tends towards an equilibrium phase wherein the optical state of the pixel is steady. Such low drive voltages are typically lower than 5 volts. The term "low" means a voltage lower than is usually applied to a pixel to set its grey level with drive voltage pulses with a variable duration. The usual voltages required are typically higher than 10 volts. In the usual driving method, the grey level is substantially determined by the duration during which the drive voltage is present across the pixel. PCT International Publication Number WO 03/093900 discloses a driving method wherein the optical state of the pixel changes towards a desired grey level during an initial period in time only. After the initial period in time, the desired grey level is reached and is substantially independent on the time the low drive voltage is present.

The method to obtain an electrophoretic display and/or a driving of such a display such that the optical state does not change any further after an initial period of time, is not essential to the invention. Therefore it is not elucidated in detail. Important is to note that this way of driving is a preferred way of implementing the present invention.

These and other aspects of the invention are apparent from and will be elucidated with reference to the embodiments described hereinafter.

Figure 2:
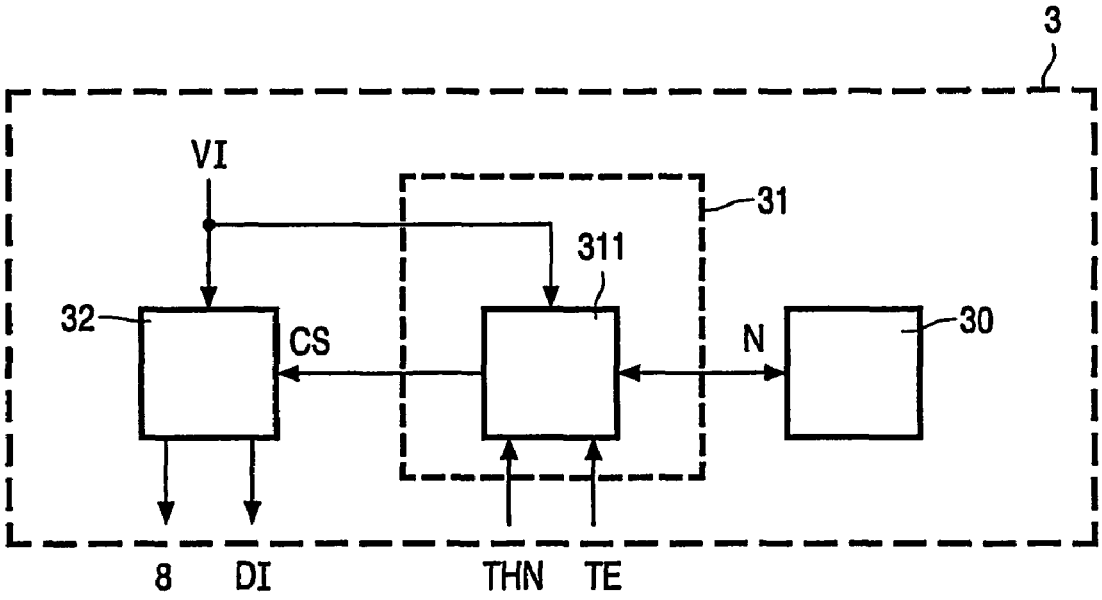
Figure 3:
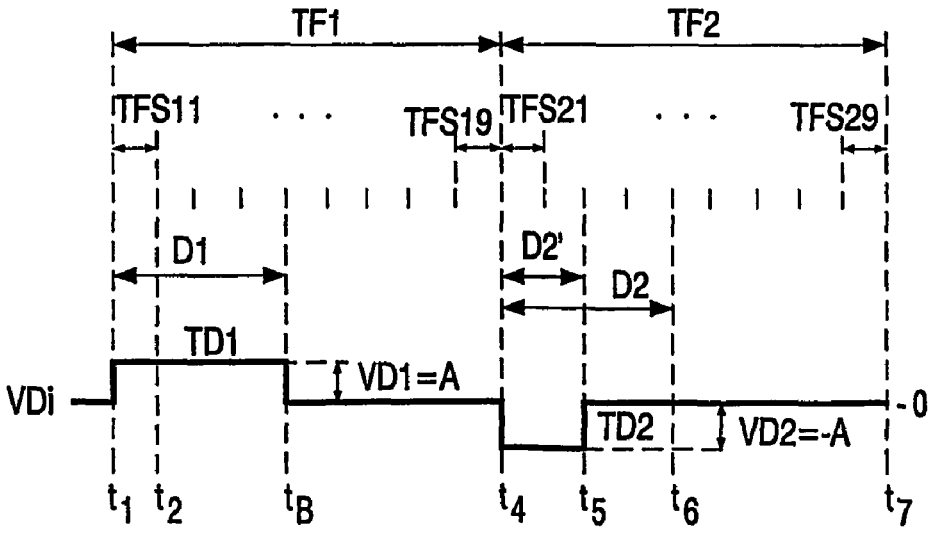

In the drawings:

FIG. 1 shows a display apparatus with a DC-balancing circuit in accordance with an embodiment of the invention, FIG. 2 shows a block diagram of an embodiment of a DC-balancing circuit, FIG. 3 shows an embodiment of a drive voltage across a particular pixel of a display device, and FIG. 4 show an embodiment of a pixel which changes optical state within a predetermined initial period of time only.

The same references in different Figs. refer to the same signals or to the same elements performing the same function. A reference in which at least one capital letter is followed by an index i or j or a combination of these indices, is meant to refer to all items which start with the same at least one capital letter and are followed by a number instead of the index i or j.

FIG. 1 shows a display apparatus with a DC-balancing circuit in accordance with an embodiment of the invention. The display apparatus 1 comprises a display device DD, drive circuits 4 and 5, and a DC-balancing circuit 3.

The electrophoretic display device DD comprises a matrix of pixels 10 which are associated with intersections of crossing data electrodes 6 (numbered 1 to n) and select electrodes 7 (numbered 1 to m). In FIG. 1, by way of example, an active addressed matrix display device DD is shown, wherein the pixels 10 comprise a transistor 9. The transistor 9 connects the voltage on the corresponding data electrode 6 to the pixel 10 when the corresponding select electrode 7 causes the transistor 9 to be conductive. The other side of the pixel 10 is grounded. Alternatively, the matrix display device DD may also be passively addressed.

A data driver 5 receives input data DI and supplies data voltages to the data electrodes 6. Select driver 4 supplies select voltages to the select electrodes 7.

A control circuit 32 (see FIG. 2) which is shown to be part of the DC-balancing circuit 3 receives an input signal VI which comprises data to be displayed and timing information which determines the position of the data on the display device DD. The control circuit 32 generates control signals 8 which are supplied to the select driver 4 and the data driver 5. Usually, the control circuit 32 controls the select driver 4 to select the select electrodes 7 one by one, and the control circuit 32 controls the data driver 5 to supply the data voltages in parallel to the pixels 10 of the selected select electrode 7 via the data electrodes 6.

Usually the drive voltage VDi across the pixel 10 has a fixed positive or negative value to change the optical state of the pixel towards one of two stable limit states. The required optical state of a pixel is obtained by varying the duration Di of the drive period TDi during which the drive voltage VDi is present across the pixel 10 (See FIG. 3). Usually, the electrophoretic matrix display is driven in fields TFi of sub-fields TFSij. During a sub-field TFSij, to each of the pixels 10, a drive voltage VDi with the appropriate level and polarity is supplied. The duration Di is controlled by selecting in which sub-fields TSFij which pixel 10 receives which polarity of the drive voltage VDi. For example, a pixel 10 with a black state may be changed into a dark grey state by supplying a drive voltage VDi with a positive polarity during one of the sub-fields TFSij.

The DC-balancing circuit 3 keeps track of the average voltage across each of the pixels 10 and adapts the level of the drive voltage VDi or the duration Di of the drive period TDi (see FIG. 3) during which the drive voltage VDi is supplied to a particular pixel 10 such that the average value of the drive voltage VDi across the pixel 10 is substantially zero. A microprocessor 311 may calculate the average voltage and the required level of the drive voltage VDi and/or the required duration of the drive period IDi. The level of the drive voltage VDi may be varied by adapting the input data DI supplied to the data driver 5. The duration of the drive period TDi usually is varied in steps having the duration of a sub-field period TSFij as elucidated above.

In FIG. 1, further an optional temperature measurement element 11 is shown which supplies a signal TE indicative of the temperature of the pixel 10. The signal TE may be used by the micro-processor 311 to adjust the number dependent on the temperature.

FIG. 2 shows a block diagram of an embodiment of a DC-balancing circuit. The DC-balancing circuit 3 comprises the control circuit 32 already discussed, a memory 30 and a controller 31. The controller 31 stores a number N for each pixel 10 of the display device DD in the memory 30, such that the average value of the voltage-duration is stored for every pixel 10.

The controller 31 determines the average voltage-duration by summing to the number N, the duration Di of the present drive period TDi multiplied by the value A (see FIG. 3) of the present drive voltage VDi across the pixel 10 during the present drive period TDi. Consequently, the number N represents the drive voltage VDi integrated from a selected starting instant up to the present instant. In a sub-field driven display wherein the sub-fields TFSij all have the same duration, the duration Di is indicated by the number of sub-fields the drive voltage VDi is present across the pixel 10. This number of sub-fields is further referred to as the active number (of sub-fields). If the drive voltage VDi has the fixed levels A (a positive drive voltage with level A), −A (a negative drive voltage with the level A), or zero, the summing is particularly simple. If the drive voltage VDi is positive, the number N becomes equal to the present number N plus the active number, if the drive voltage VDi is negative, the number N becomes equal to the present number N minus the active number, and if the drive voltage VDi is zero, the number N is not changed.

The starting instant may be the instant the display device DD is manufactured. It is also possible that the starting instant is defined as the instant at which the display apparatus is switched-on. The starting instant may also be defined on a regular time basis. In the last two examples, the number N is reset to zero regularly. Usually, this is not a problem as the image retention is predominantly determined by a recent history of the drive voltage VDi across the pixel 10.

The controller 31 may comprise a calculating unit 311 which, for example, is a micro-processor. Before the start of a drive period TDi of a particular pixel 10, the calculating unit 311 reads the number N for this particular pixel 10 from the memory 30. Then, the calculating unit 311 evaluates the input signal VI and calculates the level of the present drive voltage VD and/or the duration of the present drive period TDi such that the correct optical state of the pixel 10 will be reached and such that an absolute value of the number N becomes minimal. The calculated values are supplied in a control signal CS to the control circuit 32. The control circuit 32 adapts the level of the present drive voltage VDi and/or the duration of the present drive period TDi accordingly. Further, for the particular pixel 10, the calculating unit 311 sums the present value of the drive voltage VDi multiplied with the duration of the present drive period TDi to the number N and stores the new value of N in the memory 30. Preferably, the calculating unit 311 performs these operations for all the pixels 10 of the matrix display.

Optionally, the controller 31 may receive a threshold level THN to control the control circuit 32 to supply a reset pulse to the pixel 10. Further, the controller 31 may receive the signal TE which indicates the temperature of the pixel 10. The number N may be adapted with the temperature measured to take into account the influence of the temperature on the image retention. In the same manner the controller 31 may take the value of the drive voltage VD into account. These optional activities may be performed by the micro-processor 311, or dedicated hardware may be used.

FIG. 3 shows an embodiment of a drive voltage across a particular pixel of a display device. In FIG. 3, two frame periods TF1 and TF2 are shown, which, as an example only, both comprise 9 sub-fields. The frame period TF1 which starts at the instant t1 and ends at the instant t4 comprises the sub-field periods TSF11 to TSF19. The frame period TF2 which starts at the instant t4 and ends at the instant t7 comprises the sub-field periods TSF21 to TSF29.

In general, a frame or a frame period is referred to as TFi, and a sub-field or a sub-field period is referred to as TSFij. As an example only, the duration of each of the sub-field periods TSFij is equal to the duration of the sub-field period TSF11 which last from instant t1 to t2. Usually, the duration of the different sub-fields periods TSFij in the same field period TFi are the same, but this is not essential. Usually, the corresponding sub-fields periods TSFij in different field periods TFi have the same duration.

First, the situation is discussed without the DC-balancing. A particular pixel 10, in each of the fields TFi has to be brought into an optical state corresponding to the input signal VI. It is assumed that the input signal VI requires a drive voltages VDi for the two drive periods TD1 and TD2 which have a level VD1=A and VD2=−A, and a duration DI, D2', respectively. The duration DI lasts four sub-field periods TSFij, and the duration D2' lasts two sub-field periods TSFij.

Secondly, it is assumed that in the display device DD used, the optical state of the pixel 10 will not change after a minimal initial period of time. Therefore, it is possible to extend the duration D2' to four sub-field periods TSFij without influencing the required optical state of the pixel 10. This extension to the duration D2 is determined by the DC-balancing circuit 3 such that the number N becomes zero.

It is assumed that the number N is zero before the drive period TD1 starts. After the drive period TD1, the number N has the value A×D1=4×A. At the start of the drive period TD2, the calculating unit 311 detects that the polarity of the input signal V1 to be displayed on the particular pixel 10 has the opposite polarity as in the drive period TD1. The calculating circuit checks the input signal VI for the required number of sub-field periods TSFij the drive voltage VD2 will have to be supplied to the pixel 10 to reach the required optical state. Now several options exist.

Firstly, as shown in FIG. 3, the required number of sub-field periods TSFij is smaller than the number of sub-field periods TSFij required to obtain a zero value of the number N. Now, the drive period TD2 is extended to the number of sub-field periods TSFij required to obtain a value zero for the number N. In FIG. 3, the drive period TD2 is extended from two to four sub-field periods TSFij and lasts from t4 to t6 instead of to t5.

Secondly, the required number of sub-field periods TSFij is larger than the number of sub-field periods TSFij required to obtain a zero value of the number N. The number of sub-field periods TSFij is not changed. The value of the number N will become negative.

Thirdly, the required number of sub-field periods TSFij is equal to the number of sub-field periods TSFij required to obtain a zero value of the number N. The number of sub-field periods TSFij is not changed. The value of the number N will become zero.

FIG. 4 shows an embodiment of a pixel which changes optical state within a predetermined initial period of time only. The pixel 10 comprises a first substrate 11, for example, of glass or a synthetic material, provided with the switching electrode 7, and a second, transparent substrate 12 provided with a switching electrode 6. The pixel is filled with an electrophoretic medium, for example, a white suspension 13 containing, in this example, positively charged, black particles 14. Further, the pixel 10 is provided with a third electrode 6' to realize intermediate optical states.

Figure 4A:
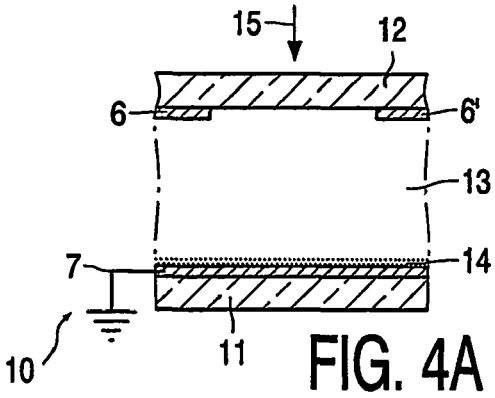

For example, in FIG. 4A, the switching electrode 7 is connected to ground, while both the electrodes 6 and 6' are connected to a voltage +V. The black particles 14 move towards the electrode at the lowest potential, in this case the electrode 7. Viewed from the viewing direction 15, the pixel 10 now has the color of the liquid 13 (which is white in this example).

Figure 4B:
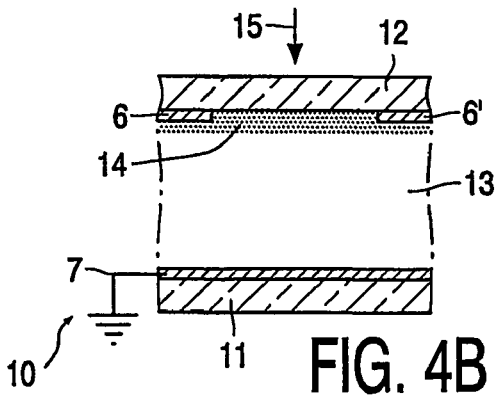

In FIG. 4B, the switching electrode 7 is connected to ground, while both the electrodes 6 and 6' are connected to a voltage −V. The positively charged black particles move towards the lowest potential, in this situation towards the potential plane defined by the electrodes 6 and 6', parallel and just along side the substrate 12. Viewed from the viewing direction 15, the pixel now has the color black of the particles 14.

Figure 4C:
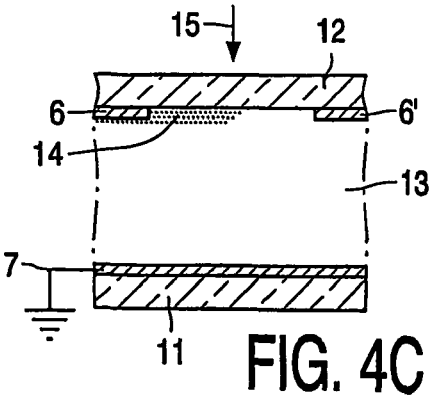
Figure 4D:
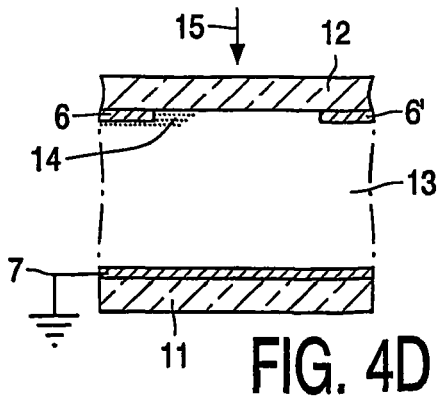

In FIG. 4C, the switching electrode 7 is connected to ground again, while the electrode 6 is connected to the voltage −V and the electrode 6' is connected to ground. The positively charged black particles move to the lowest potential which is the area around the electrode 6. This is even more strongly the case when the third electrode 6' is connected to the voltage +V, as is shown in FIG. 4D. Viewed from the viewing direction 15, the pixel 10 now has only partly the color of the black particles 14 and partly the color of the white liquid, and a grey level is obtained (dark grey in the case of FIG. 4C, and light grey in the case of FIG. 4D). Several different types of electrophoretic devices are possible, types in which the charged particles move upwards and downwards (i.e. transverse to the plane of the display) or lateral to the plane of the display device.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. The word "comprising" does not exclude the presence of elements or steps other than those listed in a claim. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A display apparatus for displaying an image, the display apparatus comprising:

a matrix display device comprising a plurality of pixels having electrodes, an optical state of each pixel being defined by particles moving in a fluid between the electrodes dependent on parameters selected from at least one of a value of a drive voltage, a polarity of the drive voltage, or a duration of a drive period during which the drive voltage is present across the electrodes of the pixel;

a driver for supplying a sequence of the drive voltages across the electrodes of the pixel during corresponding successive drive periods, each sequence of the drive voltages being applied according to input image data that produces the displayed image; and a DC-balancing circuit comprising a controller for:

adjusting at least one of the parameters to determine a time-average value of the drive voltages for the pixel, the time-average value being a sum of products of the drive voltage values with corresponding polarities and drive period durations, and adjusting the time-average value substantially to zero while the pixel is being driven according to the input image data, and a memory for storing the sum, wherein the controller is adapted for comparing an absolute value of the sum with a threshold number; and controlling the driver to supply a reset pulse to the pixel when the absolute value of the sum surpasses the threshold number.

2. The display apparatus as claimed in claim 1, further comprising a control circuit for driving the matrix display device in a sub-field mode wherein grey scales of the pixels are determined by a plurality of sub-fields receiving the drive voltages, and wherein the drive period is the duration of the plurality of sub-fields receiving the drive voltage.

3. The display apparatus as claimed in claim 1, wherein the display device further comprises a temperature sensor for sensing a temperature of the pixel, and wherein the controller is further adapted for modifying the sum dependent on the temperature.

4. The display apparatus as claimed in claim 1, wherein the controller is adapted for modifying the sum non-linearly dependent on the values of the drive voltages.

5. The display apparatus as claimed in claim 1, wherein after an initial period of time required to obtain a desired coloration of the pixel, the desired coloration is substantially independent from a duration of a pre-determined drive voltage, and wherein the controller is adapted for controlling the duration of the pre-determined drive voltage to be longer than the initial period of time when a polarity of the pre-determined drive voltage is opposite to a polarity of the sum.

6. The display apparatus as claimed in claim 5, wherein the controller is adapted for controlling the duration of the pre-determined drive voltage not to become longer than the initial period of time when the polarity of the sum is changed after the initial period of time.

7. The display apparatus as claimed in claim 5, wherein the controller is adapted for controlling the duration of the pre-determined drive voltage to be substantially identical to the initial period of time when the polarity of the pre-determined drive voltage and the polarity of the sum are identical.

8. The display apparatus as claimed in claim 5, wherein the display device is an electrophoretic display, and wherein the pixel comprises two switching electrodes and a further electrode, the driver being adapted for supplying the sequence of drive voltages to the two switching electrodes and the further electrode controlling intermediate optical states of the pixel.

9. The display apparatus as claimed in claim 5, wherein the display device is an electrophoretic display, wherein the pixel comprises at least two electrodes, and wherein the driver is adapted for supplying the sequence of drive voltages between the at least two electrodes for setting a grey scale of the pixel by providing a drive voltage lower than a usually applied drive voltage which sets a grey level by modulating the duration of the drive period during which the usually applied drive voltage is present.

10. The display apparatus as claimed in claim 1, wherein the display device is an electrophoretic display.

11. A method of displaying an image by driving a matrix display device comprising a plurality of pixels, an optical state of each pixel being defined by particles moving in a fluid between electrodes dependent on parameters including a value of a drive voltage, a polarity of the drive voltage or a duration of a drive period during which the drive voltage is present across the electrodes of the pixel, the method comprising acts of:

supplying a sequence of the drive voltages across the electrodes of the pixels during corresponding successive drive periods, the sequence of drive voltages being applied according to input image data that produces the displayed image;

adjusting at least one of the parameters to obtain a time-average value of the drive voltages for the pixel so that the time-average value is a substantially zero while the pixel is being driven according to the input image data that produces the displayed image, the time-average value being a sum of products of the drive voltage values with corresponding polarities and drive period durations;

comparing an absolute value of the sum with a threshold number; and supplying a reset pulse to the pixel when the absolute value of the sum surpasses the threshold number.

12. A display apparatus for displaying a plurality of images, the display apparatus comprising:

a matrix display device comprising a plurality of pixels having electrodes, an optical state of each pixel being defined by particles moving in a fluid between the electrodes dependent on parameters selected from at least one of a value of a drive voltage, a polarity of the drive voltage, or a duration a drive period during which the drive voltage is present across the electrodes of the pixel;

a driver for supplying a sequence of the drive voltages across the electrodes of the pixel during corresponding successive drive periods, the sequence of the drive voltages being applied according to input image data that produces one of the plurality of displayed images; and a DC-balancing circuit comprising a controller for comparing an absolute value of a sum of products of the drive voltage values with corresponding polarities and drive period durations with a threshold number; and controlling the driver to supply a reset pulse to the pixel when the absolute value of the sum surpasses the threshold number.

* * * * *